US010674271B2

(12) United States Patent
Ikeuchi

(10) Patent No.: US 10,674,271 B2
(45) Date of Patent: Jun. 2, 2020

(54) FLAT SPEAKER AND DISPLAY DEVICE

(71) Applicant: Panasonic Intellectual Property Management Co., Ltd., Osaka (JP)

(72) Inventor: Kazuhiko Ikeuchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/339,398

(22) PCT Filed: Oct. 11, 2017

(86) PCT No.: PCT/JP2017/036740

§ 371 (c)(1),
(2) Date: Apr. 4, 2019

(87) PCT Pub. No.: WO2018/070399

PCT Pub. Date: Apr. 19, 2018

(65) Prior Publication Data

US 2019/0238986 A1 Aug. 1, 2019

(30) Foreign Application Priority Data

Oct. 13, 2016 (JP) ..... 2016-201991

(51) Int. Cl.
*H04R 7/18* (2006.01)
*H04R 7/04* (2006.01)
(Continued)

(52) U.S. Cl.
CPC ..... *H04R 7/18* (2013.01); *H04R 1/02* (2013.01); *H04R 7/04* (2013.01); *H04R 7/26* (2013.01);
(Continued)

(58) Field of Classification Search
CPC ... H04R 7/18; H04R 7/26; H04R 1/02; H04R 7/04; H04R 1/2857; H04R 9/04;
(Continued)

(56) References Cited

U.S. PATENT DOCUMENTS 1,863,072 A 6/1932 Smythe
6,807,051 B2 * 10/2004 Takahashi ..... H04N 5/642 348/E5.13
(Continued)

FOREIGN PATENT DOCUMENTS

JP 48-047825 7/1973
JP 2004-260346 9/2004
(Continued)

OTHER PUBLICATIONS

International Search Report of PCT application No. PCT/JP2017/036740 dated Dec. 12, 2017.
(Continued)

*Primary Examiner* — Oyesola C Ojo
(74) *Attorney, Agent, or Firm* — McDermott Will & Emery LLP

(57) ABSTRACT

A flat speaker includes a diaphragm having a flat plate shape, a drive unit that is attached to a back surface of the diaphragm and vibrates the diaphragm, a fixing member that fixes an outer circumference of the diaphragm in a circumferential direction, a first support member that is disposed on an inner side in a radial direction of the fixing member, supports the back surface of the diaphragm in the circumferential direction, and has a value of hardness smaller than a value of hardness of the fixing member and/or a value of internal loss larger than a value of internal loss of the fixing member, and a second support member that is disposed on an inner side in the radial direction of the first support member, supports the back surface of the diaphragm in the
(Continued)

circumferential direction, and has a value of hardness smaller than the value of hardness of the first support member and/or a value of internal loss larger than the value of internal loss of the first support member.

16 Claims, 11 Drawing Sheets

(51) Int. Cl.

| | |
|---|---|
| ***H04R 7/26*** | (2006.01) |
| ***H04R 1/02*** | (2006.01) |
| ***H04R 7/10*** | (2006.01) |
| ***H04R 9/04*** | (2006.01) |
| ***H04R 1/28*** | (2006.01) |

(52) U.S. Cl.
CPC ..... *H04R 1/2857* (2013.01); *H04R 7/10* (2013.01); *H04R 9/04* (2013.01); *H04R 2307/201* (2013.01); *H04R 2440/07* (2013.01); *H04R 2499/15* (2013.01)

(58) Field of Classification Search
CPC ..... H04R 7/10; H04R 2307/201; H04R 2440/07; H04R 2499/15
See application file for complete search history.

(56) References Cited

U.S. PATENT DOCUMENTS

| | | | | |
|---|---|---|---|---|
| 7,518,671 | B2 * | 4/2009 | Maruta | G02F 1/133308 349/58 |
| 7,658,456 | B2 * | 2/2010 | Aikawa | H04N 5/64 312/7.2 |
| 8,548,190 | B2 * | 10/2013 | Hori | H04R 3/02 381/396 |
| 10,205,810 | B2 * | 2/2019 | Lee | H04M 1/03 |
| 2004/0163883 | A1 * | 8/2004 | Suzuki | H04R 7/18 181/173 |
| 2005/0080986 | A1 | 4/2005 | Park | |
| 2008/0285778 | A1 * | 11/2008 | Kuroda | G03B 21/565 381/152 |
| 2009/0261694 | A1 * | 10/2009 | Yamanaka | G06F 1/1601 312/7.2 |
| 2016/0014247 | A1 * | 1/2016 | Behles | H04M 1/035 455/566 |
| 2019/0196641 | A1 * | 6/2019 | Ryu | B32B 9/04 |
| 2019/0268681 | A1 * | 8/2019 | Masuda | G09F 9/00 |

FOREIGN PATENT DOCUMENTS

| | | | | |
|---|---|---|---|---|
| JP | 2005-115910 | | 4/2005 | |
| JP | 2005-198217 | | 7/2005 | |
| JP | 2006-332861 | | 12/2006 | |
| JP | 2006332861 | A * | 12/2006 | H04R 7/04 |
| JP | 2008-060751 | | 3/2008 | |
| JP | 2009-100223 | | 5/2009 | |
| JP | 2009-290346 | | 12/2009 | |
| JP | 2009290346 | A * | 12/2009 | H04R 1/02 |
| WO | 2001/010168 | A2 | 2/2001 | |
| WO | WO-0110168 | A2 * | 2/2001 | H04R 1/2857 |

OTHER PUBLICATIONS

Communication pursuant to Rule 164(1) EPC dated Jul. 25, 2019 for the related European Patent Application No. 17860384.1.

* cited by examiner

FLAT SPEAKER AND DISPLAY DEVICE

CROSS-REFERENCE TO RELATED APPLICATIONS

This application is a U.S. national stage application of the PCT International Application No. PCT/JP2017/036740 filed on Oct. 11, 2017, which claims the benefit of foreign priority of Japanese patent application No. 2016-201991 filed on Oct. 13, 2016, the contents all of which are incorporated herein by reference.

TECHNICAL FIELD

The present disclosure relates to a flat speaker and a display device including the flat speaker.

BACKGROUND ART

Some display devices such as liquid crystal television receivers are equipped with a flat speaker. The flat speaker disclosed in PTL 1 includes a diaphragm having a flat plate shape, an exciter that is attached on a back surface of the diaphragm, and a fixing member that fixes an outer circumference of the diaphragm in a circumferential direction. The diaphragm configures a display panel of a display device. A vibration of the exciter is transmitted to the diaphragm, and sound is emitted from the diaphragm.

CITATION LIST

Patent Literature

PTL 1: Unexamined Japanese Patent Publication No. 2009-100223

SUMMARY

The present disclosure provides a flat speaker that is capable of improving acoustic characteristics, and a display device that includes the flat speaker.

The flat speaker according to the present disclosure includes a diaphragm having a flat plate shape, a drive unit that is attached to a back surface of the diaphragm and vibrates the diaphragm, a fixing member that fixes an outer circumference of the diaphragm in a circumferential direction, a first support member that is disposed on an inner side in a radial direction of the fixing member, supports the back surface of the diaphragm in the circumferential direction, and has a value of hardness smaller than a value of hardness of the fixing member and/or a value of internal loss larger than a value of internal loss of the fixing member, and a second support member that is disposed on an inner side in the radial direction of the first support member, supports the back surface of the diaphragm in the circumferential direction, and has a value of hardness smaller than the value of hardness of the first support member and/or a value of internal loss larger than the value of internal loss of the first support member.

The display device according to the present disclosure includes the flat speaker.

By employing the flat speaker and the display device according to the present disclosure, acoustic characteristics can be improved.

Figure 1:
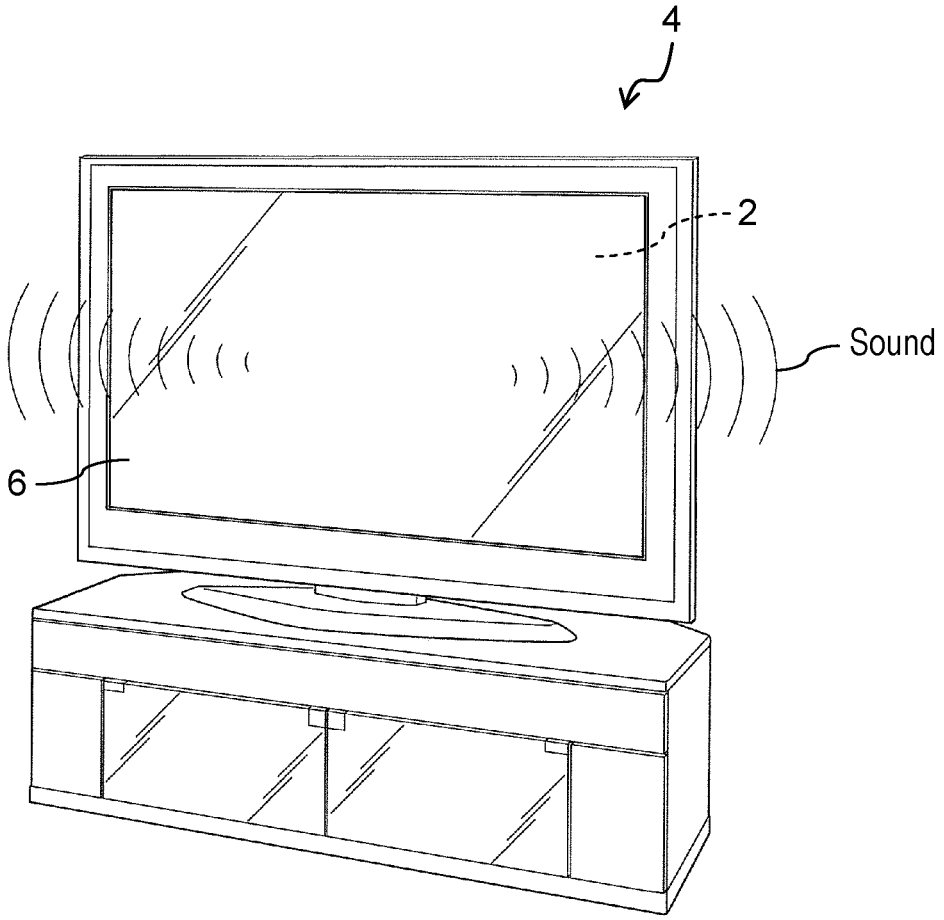
FIG. 1 is a perspective view schematically illustrating an example of a display device equipped with a flat speaker according to a first exemplary embodiment.

DESCRIPTION OF EMBODIMENTS (Knowledge Underlying the Present Disclosure)

The inventor of the present application has found the following problems in the technique disclosed in PTL 1.

In a configuration of the flat speaker disclosed in PTL 1, it is difficult to sufficiently suppress a vibration of the outer circumference of the diaphragm. Therefore, a vibration that is transmitted from the exciter to the outer circumference of the diaphragm and a vibration that is reflected by the outer circumference of the diaphragm and is transmitted to the exciter may fail to be sufficiently canceled. In this case, both of the vibrations described above may interfere with each other, the diaphragm may dividedly resonate, and acoustic characteristics of the flat speaker may be reduced.

Exemplary embodiments are described below in detail with reference to the drawings where appropriate. However, a detailed description beyond necessity may be omitted. For example, detailed descriptions of already well-known matters, a duplicated description of a substantially identical configuration, and the like may be omitted. This is to avoid unnecessary redundancy in the description below and to make the description below easily understandable to those skilled in the art.

The accompanying drawings and the exemplary embodiments described below are provided for those skilled in the art to fully understand the present disclosure, and only indicate an example of the present disclosure. Numerical values, shapes, materials, components, disposition positions and connection modes of the components, and the like that are described in the exemplary embodiments below are merely examples, and therefore these are not intended to limit a subject-matter described in the claims. Among components in the exemplary embodiments below, a component that is not described in an independent claim indicating the highest concept is a component that can be added to a component described in the independent claim in any way.

Each of the drawings is not always exactly illustrated, and is a schematic diagram that is simplified as appropriate for the purpose of illustrating the present disclosure in an easily understandable manner. In each of the drawings, substantially identical components are given identical reference marks, and descriptions of such components may be omitted or simplified.

Three axes, an X-axis, a Y-axis, and a Z-axis, are illustrated in each of the drawings, and the exemplary embodiments below are described using the XYZ-axes as needed. In these exemplary embodiments, for convenience, a direction parallel (substantially parallel) to one side of display panel 6 is taken as an X-axis direction, a direction parallel (substantially parallel) to another side that is orthogonal to the one side of display panel 6 is taken as a Y-axis direction, and a direction orthogonal to both the X-axis and the Y-axis is taken as a Z-axis direction. In addition, a direction in which an image is displayed on display panel 6 is taken as a Z-axis positive direction. In the description below, a direction relatively away from the Z-axis positive direction may be referred to as "upper", and a direction relatively away from a Z-axis negative direction may be referred to as "lower". These directions are not absolute directions, but are relative directions that are illustrated for convenience. The present disclosure is not limited to these directions.

First Exemplary Embodiment

A first exemplary embodiment is described below with reference to FIGS. 1 to 6.

[1-1. General Configuration of Flat Speaker]

First, a general configuration of flat speaker 2 according to the first exemplary embodiment is described with reference to FIGS. 1 to 4.

FIG. 1 is a perspective view schematically illustrating an example of display device 4 equipped with flat speaker 2 according to the first exemplary embodiment.

Figure 2:
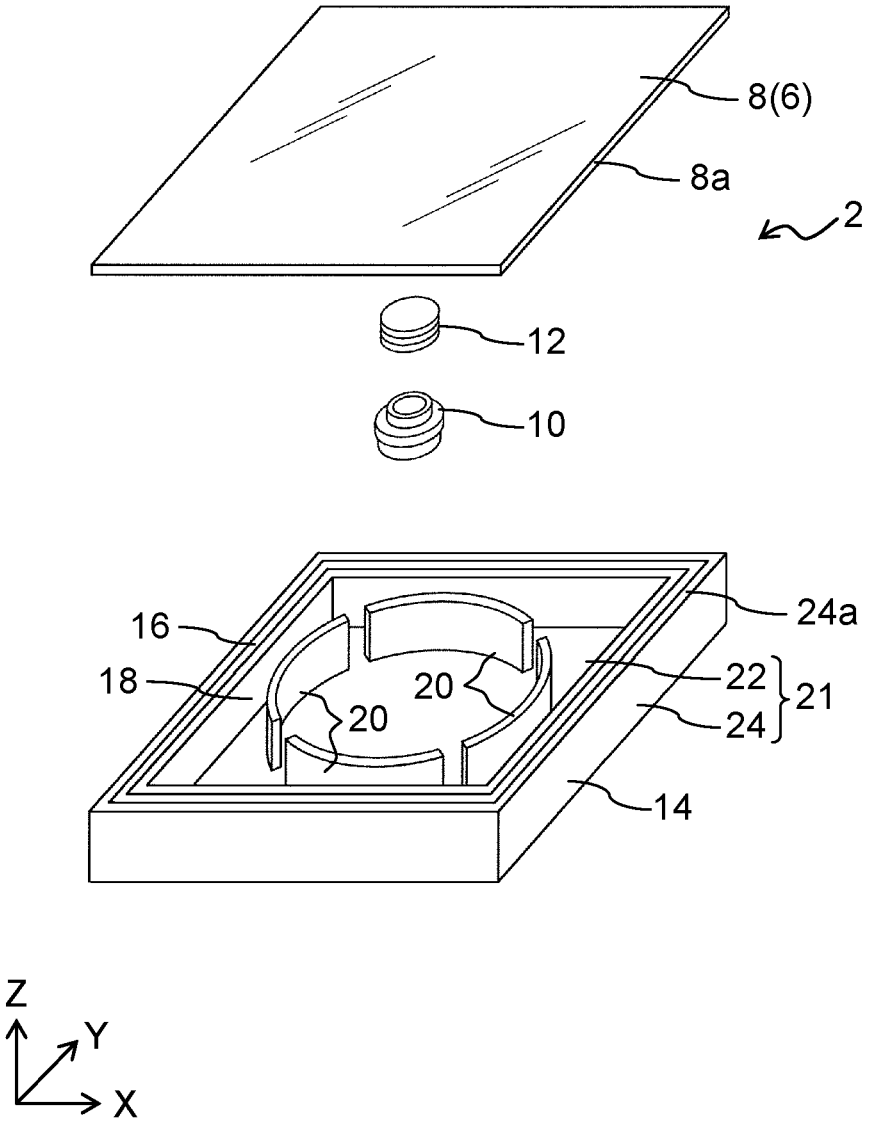
FIG. 2 is an exploded perspective view schematically illustrating an example of a configuration of the flat speaker according to the first exemplary embodiment.

FIG. 2 is an exploded perspective view schematically illustrating an example of a configuration of flat speaker 2 according to the first exemplary embodiment.

Figure 3:
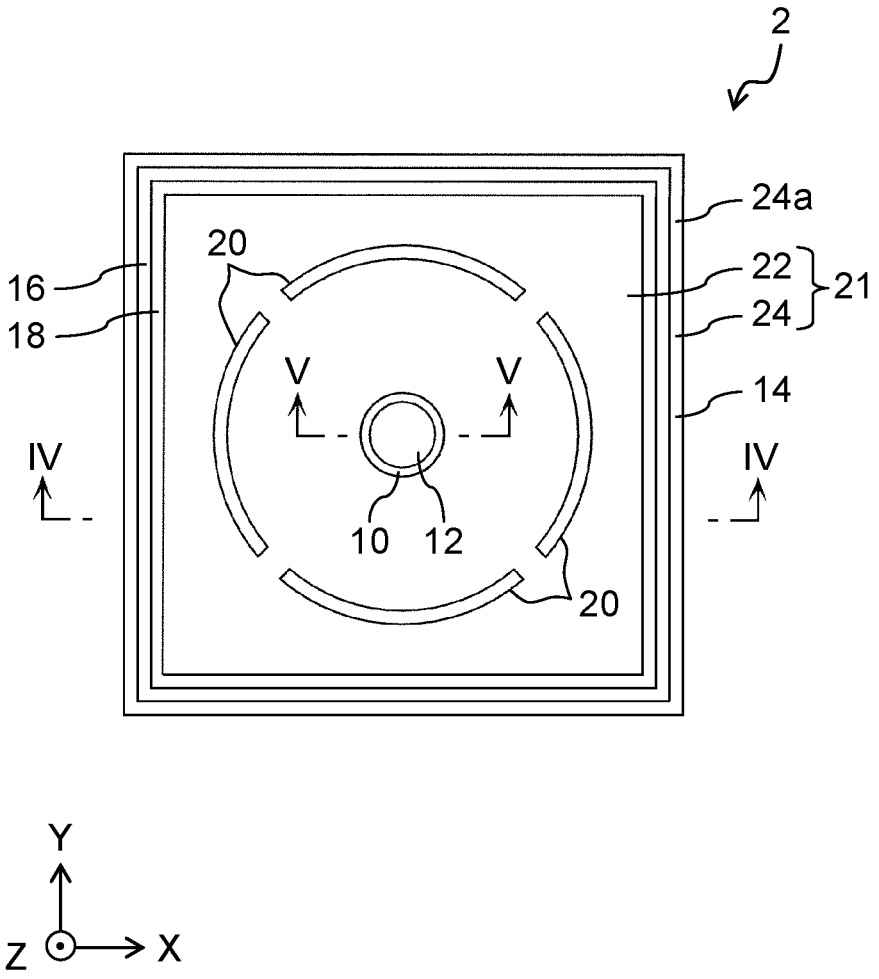
FIG. 3 is a plan view schematically illustrating an example of the configuration of the flat speaker according to the first exemplary embodiment.

FIG. 3 is a plan view schematically illustrating an example of the configuration of flat speaker 2 according to the first exemplary embodiment. FIG. 3 is a plan view in which flat speaker 2 from which diaphragm 8 (see FIG. 2) is removed is viewed from a Z-axis positive direction side.

Figure 4:
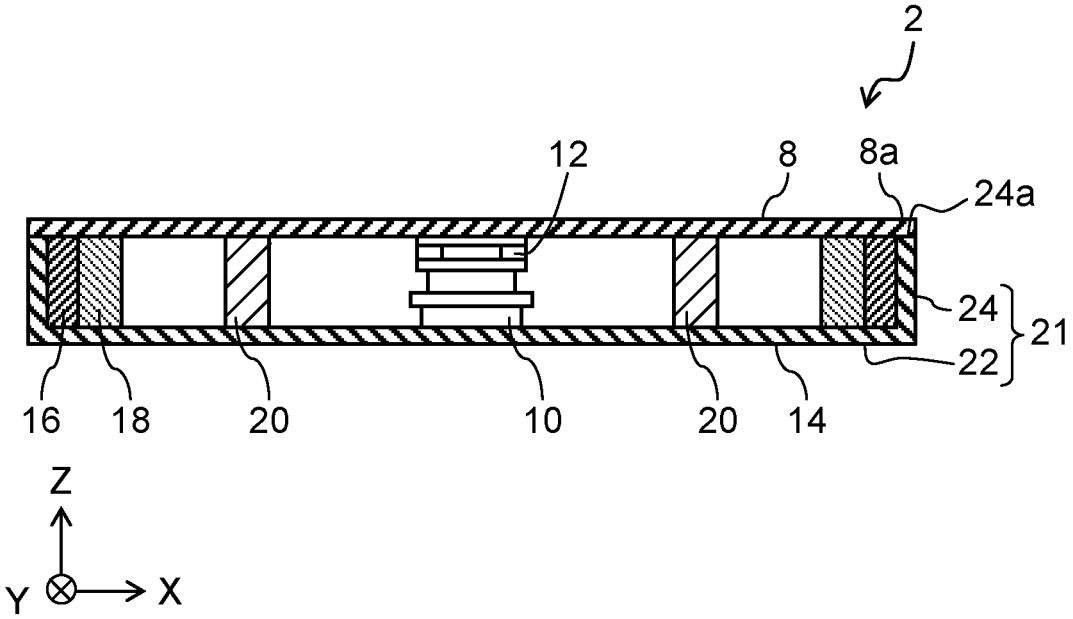
FIG. 4 is a sectional view schematically illustrating an example of the configuration of the flat speaker according to the first exemplary embodiment.

FIG. 4 is a sectional view schematically illustrating an example of the configuration of flat speaker 2 according to the first exemplary embodiment. The sectional view of FIG. 4 is a sectional view taken along line IV-IV in FIG. 3.

Display device 4 illustrated in FIG. 1 is, for example, a liquid crystal television receiver. Display device 4 includes display panel 6 that displays an image (a video). Display device 4 is equipped with flat speaker 2 that causes sound to be emitted from display panel 6 by vibrating display panel 6. By doing this, in display device 4, a position of the image spatially matches a position of a sound source. Therefore, display device 4 can give, to a user who is viewing display device 4, an impression that sound is emitted from the image itself that is displayed on display panel 6, and display device 4 can make the user feel highly realistic.

As illustrated in FIGS. 2 to 4, flat speaker 2 according to the first exemplary embodiment includes diaphragm 8, drive unit 10, heat insulating member 12, fixing member 14, first support member 16, second support member 18, and a plurality of (for example, 4) third support members 20. In the present exemplary embodiment, flat speaker 2 is a sealed speaker.

Diaphragm 8 is formed to have a rectangular shape when viewed from the Z-axis direction and to have a flat plate shape when viewed from each of the X-axis direction and the Y-axis direction. Diaphragm 8 configures display panel 6 of display device 4 described above. As illustrated in FIG. 1, a shape of display panel 6 in a plan view (at the time when display panel 6 is viewed from a side of an image display surface) is a horizontally long rectangular shape. However, in each of FIG. 2 and subsequent drawings, a shape of diaphragm 8 in a plan view (when viewed from the Z-axis positive direction side) is a square for convenience.

Drive unit 10 is an actuator (what is called an exciter) that vibrates diaphragm 8. As illustrated in FIG. 4, drive unit 10 is attached in a center of a back surface (in FIG. 4, a lower surface, a surface on a Z-axis negative direction side) of diaphragm 8 via heat insulating member 12. A vibration of drive unit 10 is transmitted to diaphragm 8, diaphragm 8 vibrates, and sound is emitted from diaphragm 8. A configuration of drive unit 10 will be described later.

Heat insulating member 12 is a member that suppresses heat from being transmitted from drive unit 10 to diaphragm 8. As illustrated in FIG. 4, heat insulating member 12 is clamped between diaphragm 8 and drive unit 10. A configuration of heat insulating member 12 will be described later.

Fixing member 14 is a member that fixes an entire circumference of outer circumference 8*a* of diaphragm 8. The entire circumference of outer circumference 8*a* of diaphragm 8 is an example of a circumferential direction. As illustrated in FIGS. 2 to 4, fixing member 14 includes housing 21 having a rectangular box shape in a plan view (when viewed from the Z-axis positive direction side) with an upper surface (in FIG. 4, an upper surface, a surface on the Z-axis positive direction side) opened. Housing 21 includes bottom plate 22 and side wall 24 that is erected in an outer circumference of bottom plate 22, and housing 21 configures a rear cabinet of display device 4 described above. A size of opening edge 24*a* of side wall 24 when viewed from the Z-axis positive direction is substantially the same as a size of diaphragm 8 when viewed from the Z-axis positive direction. The entire circumference of outer circumference 8*a* of diaphragm 8 is fixed to opening edge 24*a* of side wall 24 by using an adhesive member such as an adhesive. By doing this, outer circumference 8*a* of diaphragm 8 is fixed to side wall 24 of fixing member 14, and an inside of fixing member 14 is sealed. Inside fixing member 14, drive unit 10, heat insulating member 12, first support member 16, second support member 18, and the plurality of third support members 20 are disposed. A material that fixing member 14 is formed of is a relatively hard material that can fix outer circumference 8*a* of diaphragm 8, such as resin, but may be another material.

First support member 16 is a member that supports an entire circumference (an example of the circumferential direction) of the back surface (the surface on the Z-axis negative direction side) of diaphragm 8. As illustrated in FIGS. 2 to 4, first support member 16 is disposed on an upper surface (a surface on the Z-axis positive direction side) of bottom plate 22 of fixing member 14, is disposed on an inner side in a radial direction of side wall 24 of fixing member 14, and continuously extends over the entire circumference of the back surface of diaphragm 8. A shape of first support member 16 in a plan view (when viewed from the Z-axis positive direction side) is a shape obtained by making a ring rectangular.

As illustrated in FIG. 4, first support member 16 is fixed to each of the back surface (the surface on the Z-axis negative direction side) of diaphragm 8 and the upper surface (the surface on the Z-axis positive direction side) of bottom plate 22 of fixing member 14 by using an adhesive member (not illustrated) such as an adhesive. First support member 16 is formed of a material having a value of hardness smaller than a value of hardness of fixing member 14 (and/or a value of internal loss larger than a value of internal loss of fixing member 14), namely, a material softer than a material of fixing member 14. A material that first support member 16 is formed of is, for example, a hard sponge, but may be another material. First support member 16 may be fixed to an inner circumferential surface of side wall 24 of fixing member 14 by using an adhesive member such as an adhesive.

Second support member 18 is a member that supports the entire circumference (an example of the circumferential direction) of the back surface (the surface on the Z-axis negative direction side) of diaphragm 8. As illustrated in FIGS. 2 to 4, second support member 18 is disposed on the upper surface (the surface on the Z-axis positive direction side) of bottom plate 22 of fixing member 14, is disposed on an inner side in the radial direction of first support member 16, and continuously extends over the entire circumference of the back surface of diaphragm 8. Accordingly, similarly to first support member 16, a shape of second support member 18 in a plan view (when viewed from the Z-axis positive direction side) is a shape obtained by making a ring rectangular.

As illustrated in FIG. 4, second support member 18 is fixed to each of the back surface (the surface on the Z-axis negative direction side) of diaphragm 8 and the upper surface (the surface on the Z-axis positive direction side) of bottom plate 22 of fixing member 14 by using an adhesive member (not illustrated) such as an adhesive. Second support member 18 is formed of a material having a value of hardness smaller than a value of hardness of first support member 16 (and/or a value of internal loss larger than a value of internal loss of first support member 16), namely, a material softer than a material of first support member 16. A material that second support member 18 is formed of is, for example, a hard sponge, but may be another material. Second support member 18 may be fixed to an inner circumferential surface of first support member 16 by using an adhesive member such as an adhesive.

The plurality of third support members 20 are members that support the back surface (the surface on the Z-axis negative direction side) of diaphragm 8. Each of the plurality of third support members 20 is formed to have an arc shape, as illustrated in FIG. 3. The plurality of third support members 20 are disposed on the upper surface (the surface on the Z-axis positive direction side) of bottom plate 22 of fixing member 14, are disposed on an inner side in the radial direction of second support member 18, and are disposed so as to be spaced apart from each other in a circumferential direction of one circumference. Specifically, each of the plurality of third support members 20 is disposed in a position that corresponds to a belly in which a vibration of diaphragm 8 increases. A material that the plurality of third support members 20 are formed of is, for example, a hard sponge or a soft sponge, but may be another material.

The plurality of third support members 20 may be fixed to each of the back surface (the surface on the Z-axis negative direction side) of diaphragm 8 and the upper surface (the surface on the Z-axis positive direction side) of bottom plate 22 of fixing member 14 by using an adhesive member (not illustrated) such as an adhesive.

In the first exemplary embodiment, a configuration example has been described in which a number of third support members 20 is 4. However, the number of third support members 20 is by no means limited to 4, and may be any number other than 4.

[1-2. Configuration of Drive Unit]

Next, a configuration of drive unit 10 is described with reference to FIG. 5.

Figure 5:
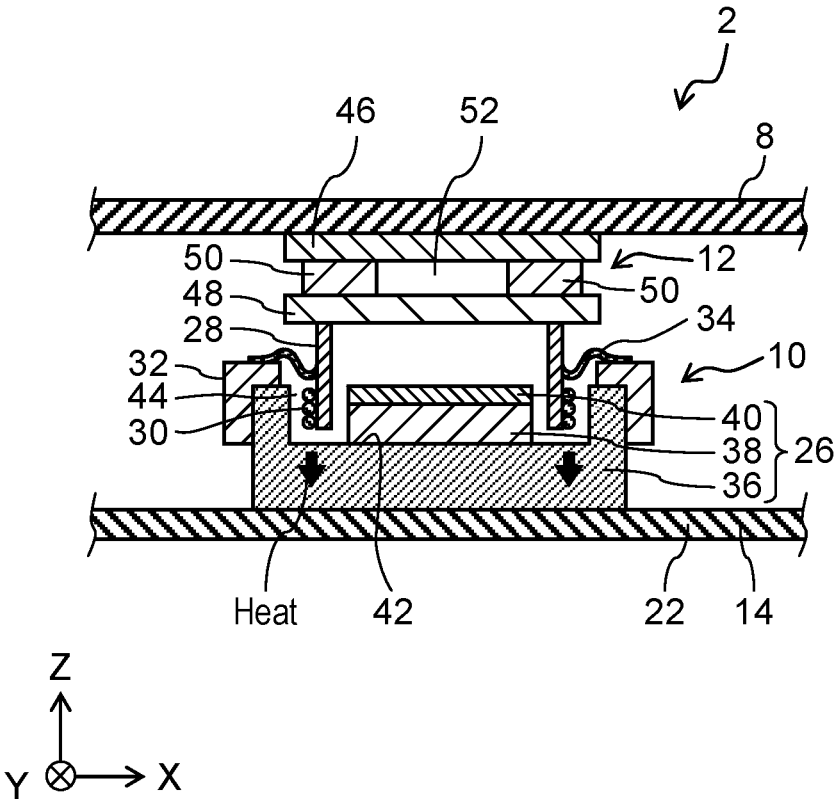
FIG. 5 is a sectional view schematically illustrating an example of a configuration of a drive unit of the flat speaker according to the first exemplary embodiment.

FIG. 5 is a sectional view schematically illustrating an example of the configuration of drive unit 10 of flat speaker 2 according to the first exemplary embodiment. The sectional view of FIG. 5 is a sectional view taken along line V-V in FIG. 3.

As illustrated in FIG. 5, drive unit 10 includes magnetic circuit 26, bobbin 28, voice coil 30, flange 32, and damper 34.

Magnetic circuit 26 includes yoke 36, magnet 38, and plate 40. Each of yoke 36, magnet 38, and plate 40 is formed of metal such as iron, and is formed to have a column shape or a disk shape. A lower surface (in FIG. 5, a lower surface, a surface on the Z-axis negative direction side) of yoke 36 is in contact with bottom plate 22 of fixing member 14. Recess 42 in which magnet 38 and plate 40 are disposed is formed in an upper end (in FIG. 5, an upper end, an end on the Z-axis positive direction side) of yoke 36. Recess 42 is formed in the upper end of yoke 36 to have a circular shape in a plan view (when viewed from the Z-axis positive direction side) and to have a shape that is recessed in the Z-axis negative direction. Magnet 38 and plate 40 are formed to have a circular shape in a plan view (when viewed from the Z-axis positive direction side). Magnet 38 is formed in such a way that a diameter of magnet 38 in a plan view (when viewed from the Z-axis positive direction side) is smaller than a diameter of recess 42 in a plan view (when viewed from the Z-axis position direction side). Plate 40 is formed in such a way that a diameter in a plan view (when viewed from the Z-axis positive direction side) is substantially the same as the diameter of magnet 38. Magnet 38 is disposed almost in a center of recess 42 of yoke 36, and plate 40 is disposed on an upper surface (a surface on the Z-axis positive direction side) of magnet 38. Magnetic gap 44 is formed between an inner circumferential surface of recess 42 of yoke 36 and an outer circumferential surface of plate 40.

Yoke 36 also functions as a heat radiation plate that radiates heat generated in drive unit 10. In order to improve heat radiation efficiency of yoke 36, a plurality of heat radiation fins may be formed in a lower edge (in FIG. 5, a lower edge, an edge on the Z-axis negative direction side) of yoke 36. Alternatively, in order to release heat generated in voice coil 30, a through-hole that penetrates magnet 38 and yoke 36 in the Z-axis direction may be formed in magnet 38 and yoke 36.

Bobbin 28 is formed to have a cylindrical shape (a cylindrical shape when viewed from the Z-axis negative direction side), and is disposed in a position that covers magnet 38 and plate 40 from an outside. Voice coil 30 is wound around a lower end (an end on the Z-axis negative direction side) of bobbin 28. Bobbin 28 is held by flange 32 via damper 34. In this state, voice coil 30 wound around the lower end of bobbin 28 is disposed in magnetic gap 44.

Flange 32 is attached to an outer circumference of an upper end (an end on the Z-axis positive direction side) of yoke 36, and is disposed in a position that covers bobbin 28 from an outside.

Damper 34 is formed to have a ring shape (a ring shape when viewed from the Z-axis positive direction side), and is attached between an outer circumferential surface of bobbin 28 and flange 32. A plurality of concentric bent parts (corrugations) are formed in damper 34.

[1-3. Configuration of Heat Insulating Member]

Next, a configuration of heat insulating member 12 is described with reference to FIGS. 5 and 6.

Figure 6:
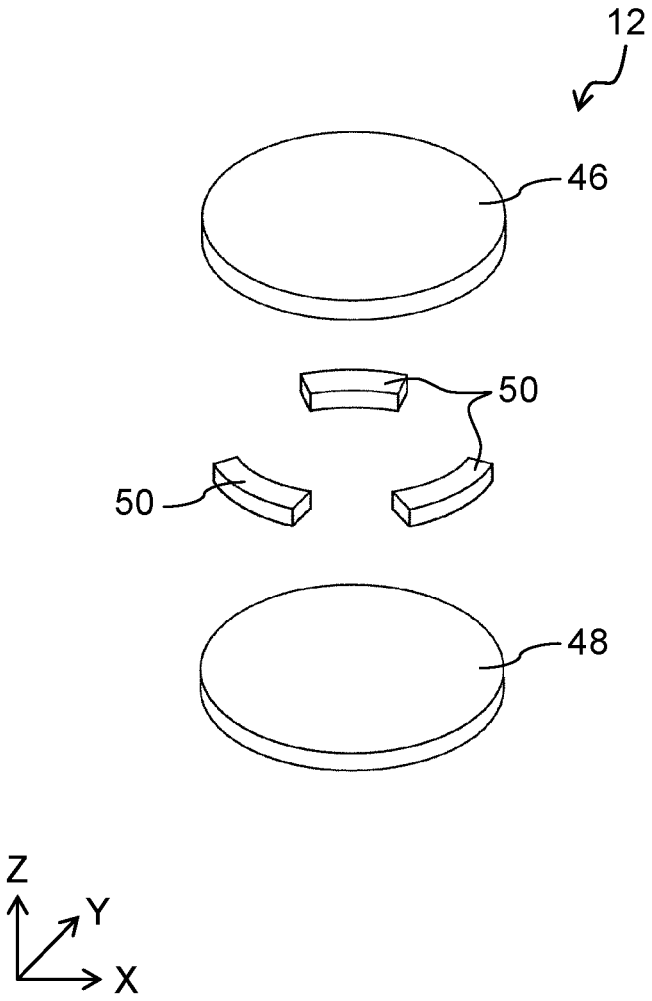
FIG. 6 is an exploded perspective view schematically illustrating an example of a heat insulating member of the flat speaker according to the first exemplary embodiment.

FIG. 6 is an exploded perspective view schematically illustrating an example of heat insulating member 12 of flat speaker 2 according to the first exemplary embodiment.

As illustrated in FIGS. 5 and 6, heat insulating member 12 includes first heat insulating plate 46, second heat insulating plate 48, and a plurality of connectors 50. Heat insulating member 12 is formed of a material having a relatively low thermal conductivity. A material that heat insulating member 12 is formed of is, for example, resin or ceramic. First heat insulting plate 46, second heat insulating plate 48, and the plurality of connectors 50 are formed of materials different from each other.

First heat insulating plate 46 is formed in a disk shape so as to have a circular shape when viewed from the Z-axis direction. First heat insulating plate 46 is fixed to be in contact (substantially in contact) with the back surface (the surface on the Z-axis negative direction side) of diaphragm 8 by using an adhesive member such as an adhesive.

Second heat insulating plate 48 is formed in a disk shape so as to have a circular shape when viewed from the Z-axis direction. Second heat insulating plate 48 is disposed on a lower side (the Z-axis negative direction side) of first heat insulating plate 46 so as to be spaced in the Z-axis direction apart from first heat insulating plate 46. Second heat insulting plate 48 is fixed to be in contact (substantially in contact) with an upper end (an end on the Z-axis positive direction side) of bobbin 28 of drive unit 10 by using an adhesive member such as an adhesive.

Each of the plurality of connectors 50 is formed to have an arc shape when viewed from the Z-axis direction. The plurality of connectors 50 are clamped between an lower surface (a surface on the Z-axis negative direction side) of first heat insulating plate 46 and an upper surface (a surface on the Z-axis positive direction side) of second heat insulating plate 48, and the plurality of connectors 50 connect first heat insulating plate 46 and second heat insulating plate 48. The plurality of connectors 50 are disposed so as to be spaced apart from each other in a circumferential direction of one circumference. The plurality of connectors 50 are fixed to each of first heat insulating plate 46 and second heat insulating plate 48 by using an adhesive member such as an adhesive. By doing this, air layer 52 according to a thickness (a size in the Z-axis direction) of connectors 50 is formed between first heat insulting plate 46 and second heat insulating plate 48, as illustrated in FIG. 5. Air layer 52 passes between connectors 50 adjacent to each other, and is communicated with an outside of heat insulating member 12.

In the present exemplary embodiment, a configuration example has been described in which connectors 50 are formed to have an arc shape, but the present disclosure is by no means limited to this configuration example. Connectors 50 may be formed to have, for example, a column shape. In the case of this configuration, the plurality of connectors 50 may be disposed between first heat insulating plate 46 and second heat insulating plate 48 in an arbitrary disposition pattern such as zigzag or a lattice shape.

[1-4. Effects]

As described above, the flat speaker according to the present exemplary embodiment includes a diaphragm having a flat plate shape, a drive unit that is attached to a back surface of the diaphragm and vibrates the diaphragm, a fixing member that fixes an outer circumference of the diaphragm in a circumferential direction, a first support member that is disposed on an inner side in a radial direction of the fixing member, supports the back surface of the diaphragm in the circumferential direction, and has a value of hardness smaller than a value of hardness of the fixing member and/or a value of internal loss larger than a value of internal loss of the fixing member, and a second support member that is disposed on an inner side in the radial direction of the first support member, supports the back surface of the diaphragm in the circumferential direction, and has a value of hardness smaller than the value of hardness of the first support member and/or a value of internal loss larger than the value of internal loss of the first support member.

Flat speaker 2 is an example of the flat speaker. Diaphragm 8 is an example of the diaphragm. Drive unit 10 is an example of the drive unit. Fixing member 14 is an example of the fixing member. First support member 16 is an example of the first support member. Second support member 18 is an example of the second support member.

As an example, flat speaker 2 described in the first exemplary embodiment includes diaphragm 8 having a flat plate shape, drive unit 10 that is attached to the back surface of diaphragm 8 and vibrates diaphragm 8, fixing member 14 that fixes outer circumference 8*a* of diaphragm 8 in the circumferential direction, first support member 16 that is disposed on the inner side in the radial direction of fixing member 14, supports the back surface of diaphragm 8 in the circumferential direction, and has a value of hardness smaller than a value of hardness of fixing member 14 and/or a value of internal loss larger than a value of internal loss of fixing member 14, and second support member 18 that is disposed on the inner side in the radial direction of first support member 16, supports the back surface of diaphragm 8 in the circumferential direction, and has a value of hardness smaller than the value of hardness of first support member 16 and/or a value of internal loss larger than the value of internal loss of first support member 16.

In flat speaker 2 configured as described above, a value of hardness increases and/or a value of internal loss decreases in the order of second support member 18, first support member 16, and fixing member 14. By doing this, a vibration that is transmitted from drive unit 10 to outer circumference 8*a* of diaphragm 8 is gradually absorbed by second support member 18, first support member 16, and fixing member 14, and a vibration that is reflected by outer circumference 8*a* of diaphragm 8 and is transmitted to drive unit 10 is reduced. As a result, both of the vibrations described above (the vibration that is transmitted from drive unit 10 to outer circumference 8*a* of diaphragm 8 and the vibration that is reflected by outer circumference 8*a* of diaphragm 8 and is transmitted to drive unit 10) can be sufficiently canceled. Therefore, division resonance of diaphragm 8 can be suppressed, and acoustic characteristics of flat speaker 2 can be improved (frequency characteristics can be flattened).

The flat speaker may further include a third support member that is disposed in a position that corresponds to a belly in which a vibration of the diaphragm increases and that supports the back surface of the diaphragm.

Third support member 20 is an example of the third support member.

As an example, flat speaker 2 described in the first exemplary embodiment further includes third support members 20 that are disposed in a position that corresponds to a belly in which the vibration of diaphragm 8 increases, and that support the back surface of diaphragm 8.

In flat speaker 2 configured as described above, secondary resonance and the like of diaphragm 8 can be suppressed from being generated, and the acoustic characteristics of flat speaker 2 can be further improved.

In the flat speaker, each of the first support member and the second support member may continuously extend over an entire circumference of the back surface of the diaphragm.

As an example, in flat speaker 2 described in the first exemplary embodiment, each of first support member 16 and second support member 18 continuously extends over the entire circumference of the back surface (the surface on the Z-axis negative direction side) of diaphragm 8.

In flat speaker 2 configured as described above, the vibration that is transmitted from drive unit 10 to outer circumference 8*a* of diaphragm 8 can be suppressed further effectively.

The flat speaker may further include a heat insulating member that is clamped between the diaphragm and the drive unit and that includes an air layer.

Air layer 52 is an example of the air layer. Heat insulating member 12 is an example of the heat insulating member.

As an example, flat speaker 2 described in the first exemplary embodiment further includes heat insulating member 12 that is clamped between diaphragm 8 and drive unit 10 and that includes air layer 52.

In flat speaker 2 configured as described above, air layer 52 of heat insulating member 12 suppresses heat generated in drive unit 10 from being transmitted to diaphragm 8. As a result, a heat insulting effect between drive unit 10 and diaphragm 8 can be improved. In particular, in the case of a configuration in which display panel 6 of display device 4 is used as diaphragm 8, the heat generated in drive unit 10 is suppressed from being transmitted to display panel 6 due to the configuration described above, and therefore display panel 6 can be suppressed from deteriorating due to heat from drive unit 10. The heat generated in drive unit 10 is transmitted, for example, to yoke 36, and is radiated from yoke 36.

In the flat speaker, the heat insulting member may include a first heat insulating plate that is in contact with the back surface of the diaphragm, a second heat insulating plate that is disposed so as to be spaced apart from the first heat insulating plate and is in contact with the drive unit, and a connector that connects the first heat insulting plate and the second heat insulating plate and forms the air layer between the first heat insulating plate and the second heat insulating plate. The first heat insulting plate, the second heat insulating plate, and the connector may be formed of materials different from each other.

First heat insulating plate 46 is an example of the first heat insulating plate. Second heat insulating plate 48 is an example of the second heat insulating plate. Connector 50 is an example of the connector.

As an example, in flat speaker 2 described in the first exemplary embodiment, heat insulting member 12 includes first heat insulating plate 46 that is in contact with the back surface of diaphragm 8, second heat insulating plate 48 that is disposed so as to be spaced apart from first heat insulating plate 46 and is in contact with drive unit 10, and connectors 50 that connect first heat insulting plate 46 and second heat insulating plate 48 and form air layer 52 between first heat insulating plate 46 and second heat insulating plate 48. First heat insulting plate 46, second heat insulating plate 48, and connectors 50 are formed of materials different from each other.

In flat speaker 2 configured as described above, first heat insulating plate 46, second heat insulating plate 48, and connectors 50 are formed of materials different from each other. Therefore, heat from second heat insulating plate 48 is hard to be transmitted to connectors 50, and heat from connectors 50 is hard to be transmitted to first heat insulating plate 46. As a result, heat from drive unit 10 to diaphragm 8 can be suppressed further effectively from being transmitted.

The display device according to the present exemplary embodiment includes the flat speaker.

Display device 4 is an example of the display device.

As an example, display device 4 according to the first exemplary embodiment includes any of flat speakers 2 described above.

By doing this, display device 4 can be provided that is equipped with flat speaker 2 having high acoustic characteristics.

Second Exemplary Embodiment

Next, a second exemplary embodiment is described with reference to FIGS. 7 and 8. In the exemplary embodiments below including the second exemplary embodiment, components substantially identical to the components described in the first exemplary embodiment are given reference marks identical to reference marks of the components described in the first exemplary embodiment, and a description is omitted.

[2-1. Configuration of Flat Speaker]

A configuration of flat speaker 2A according to the second exemplary embodiment is described with reference to FIGS. 7 and 8.

Figure 7:
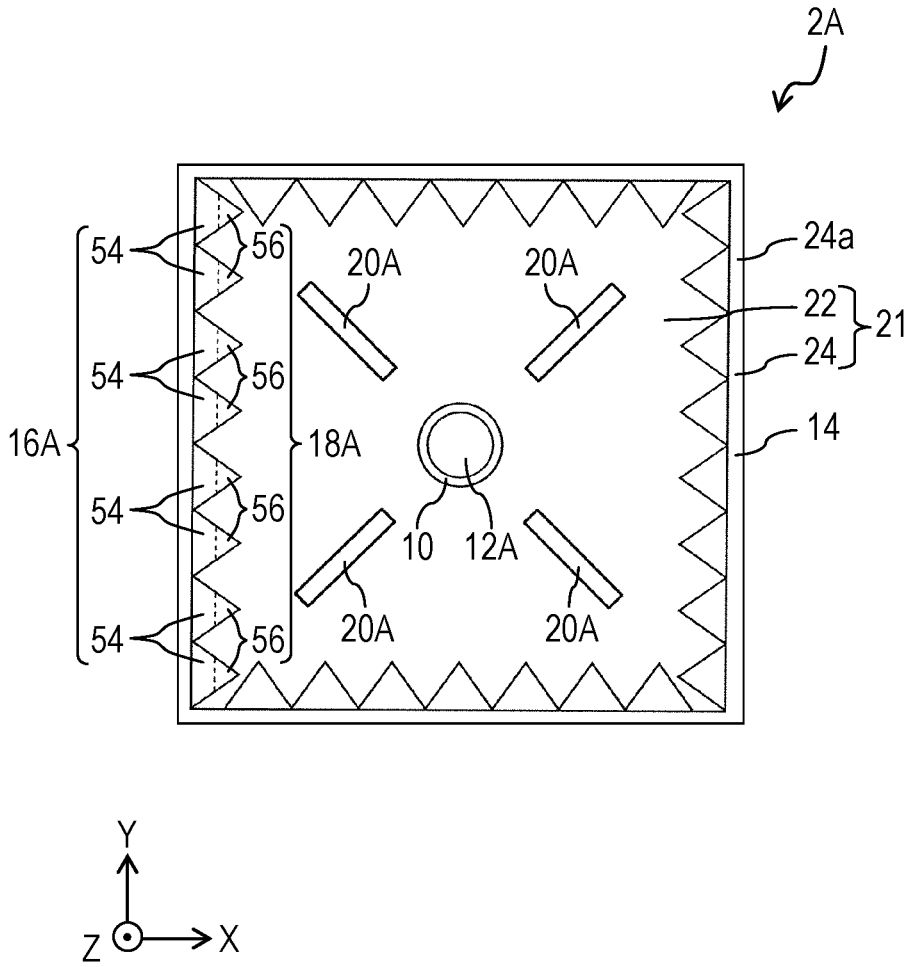
FIG. 7 is a plan view schematically illustrating an example of a configuration of a flat speaker according to a second exemplary embodiment.

FIG. 7 is a plan view schematically illustrating an example of the configuration of flat speaker 2A according to the second exemplary embodiment. FIG. 7 illustrates a plan view in which flat speaker 2A from which diaphragm 8 (see FIG. 2) is removed is viewed from the Z-axis positive direction side.

Figure 8:
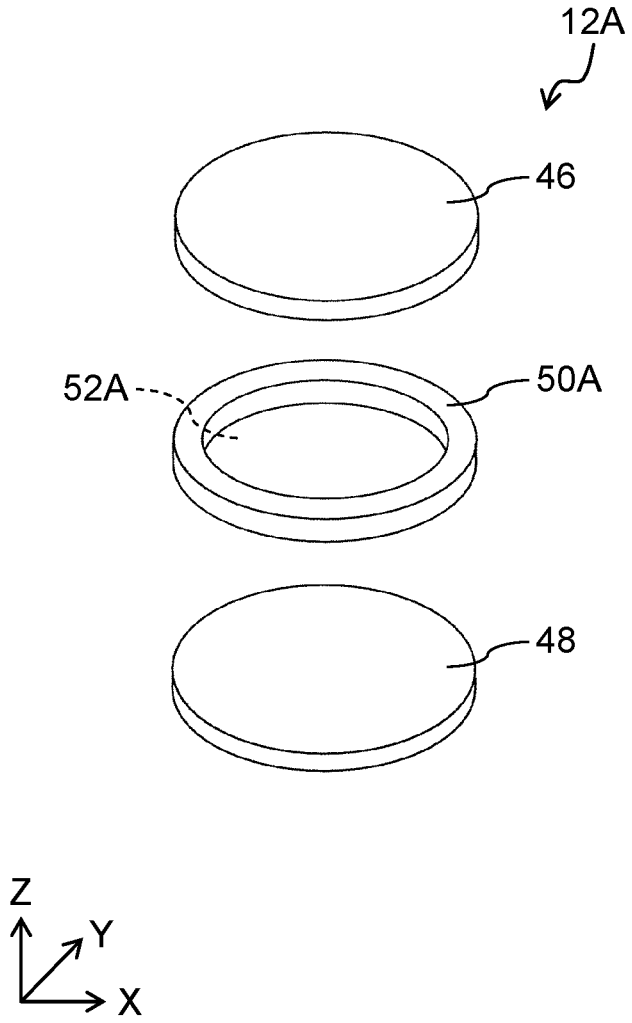
FIG. 8 is an exploded perspective view schematically illustrating an example of a heat insulating member of the flat speaker according to the second exemplary embodiment.

FIG. 8 is an exploded perspective view schematically illustrating an example of heat insulating member 12A of flat speaker 2A according to the second exemplary embodiment.

The configuration of flat speaker 2A according to the second exemplary embodiment is substantially identical to the configuration of flat speaker 2 described in the first exemplary embodiment, and a detailed description is omitted. In flat speaker 2A according to the second exemplary embodiment, respective configurations of first support member 16A, second support member 18A, and a plurality of third support members 20A that are included in flat speaker 2A are different from respective configurations of first support member 16, second support member 18, and the plurality of third support members 20 that are included in flat speaker 2 described in the first exemplary embodiment, as illustrated in FIG. 7.

First support member 16A is a member that supports the back surface (the surface on the Z-axis negative direction side) of diaphragm 8 (not illustrated in FIG. 7), similarly to first support member 16 according to the first exemplary embodiment. First support member 16A includes a plurality of first supports 54 that are disposed side by side in the circumferential direction of the back surface (the surface on the Z-axis negative direction side) of diaphragm 8. Each of the plurality of first supports 54 is formed to have, for example, a trapezoidal shape when viewed from the Z-axis direction. Each of the plurality of first supports 54 is disposed in such a way that a portion that is a base (a lower bottom) when viewed from the Z-axis direction is in contact (substantially in contact) with an inner circumferential surface of side wall 24 of fixing member 14 and adjacent first supports 54 are in contact (substantially in contact) with each other on ends of the bases (the lower bottoms). Each of the plurality of first supports 54 extends from an inner circumference of side wall 24 of fixing member 14 so as to be tapered.

The plurality of first supports 54 may be fixed to each of the back surface (the surface on the Z-axis negative direction side) of diaphragm 8 and the upper surface (the surface on the Z-axis positive direction side) of bottom plate 22 of fixing member 14 by using an adhesive member such as an adhesive. Each of the plurality of first supports 54 may be fixed to the inner circumferential surface of side wall 24 of fixing member 14 by using an adhesive member such as an adhesive.

Second support member 18A is a member that supports the back surface (the surface on the Z-axis negative direction side) of diaphragm 8 (not illustrated in FIG. 7), similarly to second support member 18 according to the first exemplary embodiment. Second support member 18A includes a plurality of second supports 56 that are disposed side by side in the circumferential direction of the back surface (the surface on the Z-axis negative direction side) of diaphragm 8. Each of the plurality of second supports 56 is formed to have, for example, a triangular shape when viewed from the Z-axis direction, and is formed in such a way that a length of a base of each of the plurality of second supports 56 is substantially the same as a length of an upper bottom of each of the plurality of first supports 54. Each of the plurality of second supports 56 is disposed in such a way that a portion that is a base when viewed from the Z-axis direction is in contact (substantially in contact) with a portion that is the upper bottom of each of the plurality of first supports 54, and each of the plurality of second supports 56 extends from a top of each of the plurality of first supports 54 so as to be tapered. By doing this, a set of single first support 54 and single second support 56 forms a single triangular shape as a whole when viewed from the Z-axis direction.

The plurality of second supports 56 may be fixed to each of the back surface (the surface on the Z-axis negative direction side) of diaphragm 8 and the upper surface (the surface on the Z-axis positive direction side) of bottom plate 22 of fixing member 14 by using an adhesive member such as an adhesive. Each of the plurality of second supports 56 may be fixed to each of the plurality of first supports 54 by using an adhesive member such as an adhesive.

First support 54 and second support 56 may be integrally formed of a material having the same value of hardness as each other (and/or the same value of internal loss as each other). On the other hand, a contact area (a substantially contact area) of first support 54 and diaphragm 8 is larger than a contact area (a substantially contact area) of second support 56 and diaphragm 8. By doing this, a value of hardness (and/or a value of internal loss) of an entirety of first support member 16A is larger than a value of hardness (and/or a value of internal loss) of an entirety of second support member 18A. As described above, in the present exemplary embodiment, the plurality of first supports 54 and the plurality of second supports 56 do not always need to be formed of materials different from each other. The plurality of first supports 54 and the plurality of second supports 56 may be formed of the same material as each other, and a set of single first support 54 and single second support 56 may be formed to have a single triangular shape as a whole when viewed from the Z-axis direction.

A plurality (for example, 4) of third support members 20A are members that support the back surface (the surface on the Z-axis negative direction side) of diaphragm 8, similarly to third support members 20 described in the first exemplary embodiment. However, each of the plurality of third support members 20A is linearly formed in contrast to third support members 20 described in the first exemplary embodiment. Each of the plurality of third support members 20A is disposed on an inner side in the radial direction of second support member 18A on the upper surface (the surface on the Z-axis positive direction side) of bottom plate 22 of fixing member 14, and is radially disposed with drive unit 10 as a center. The plurality of third support members 20A are disposed in a position that corresponds to a belly in which the vibration of diaphragm 8 increases, similarly to third support members 20 described in the first exemplary embodiment. Each of the plurality of third support members 20A is formed, for example, of a hard sponge or a soft sponge.

The plurality of third support members 20A may be fixed to each of the back surface (the surface on the Z-axis negative direction side) of diaphragm 8 and the upper surface (the surface on the Z-axis positive direction side) of bottom plate 22 of fixing member 14 by using an adhesive member (not illustrated) such as an adhesive.

Further, in flat speaker 2A according to the second exemplary embodiment, a configuration of heat insulating member 12A is different from the configuration of heat insulating member 12 described in the first exemplary embodiment, as illustrated in FIG. 8. Connector 50A of heat insulating member 12A is formed to have a ring shape in contrast to connectors 50 described in the first exemplary embodiment. Connector 50A is clamped between an lower surface (a surface on the Z-axis negative direction side) of first heat insulating plate 46 and an upper surface (a surface on the Z-axis positive direction side) of second heat insulating plate 48, and connector 50A connects first heat insulating plate 46 and second heat insulating plate 48. By doing this, air layer 52A is formed between first heat insulating plate 46 and second heat insulating plate 48. Air layer 52A is surrounded by first heat insulating plate 46, second heat insulating plate 48, and connector 50A, and is sealed from an outside of heat insulating member 12A.

In the second exemplary embodiment, a configuration example has been described in which a number of third support members 20A is 4. However, the number of third support members 20A is by no means limited to 4, and may be any number other than 4.

[2-2. Effects]

As described above, the flat speaker according to the present exemplary embodiment includes a diaphragm having a flat plate shape, a drive unit that is attached to a back surface of the diaphragm and vibrates the diaphragm, a fixing member that fixes an outer circumference of the diaphragm in a circumferential direction, a first support member that is disposed on an inner side in a radial direction of the fixing member, is disposed in the circumferential direction on the back surface of the diaphragm, is in contact with the back surface, and supports the diaphragm, and a second support member that is disposed on an inner side in the radial direction of the first support member, is disposed in the circumferential direction on the back surface of the diaphragm, is in contact with the back surface, supports the diaphragm, has a contact area with the back surface that is smaller than a contact area of the first support member and the back surface, and has a value of hardness smaller than a value of hardness of the first support member and/or a value of internal loss smaller than a value of internal loss of the first support member.

Flat speaker 2A is an example of the flat speaker. Diaphragm 8 is an example of the diaphragm. Drive unit 10 is an example of the drive unit. Fixing member 14 is an example of the fixing member. First support member 16A is an example of the first support member. Second support member 18A is an example of the second support member.

As an example, flat speaker 2A described in the second exemplary embodiment includes diaphragm 8 having a flat plate shape, drive unit 10 that is attached to the back surface of diaphragm 8 and vibrates diaphragm 8, fixing member 14 that fixes the outer circumference of diaphragm 8 in the circumferential direction, first support member 16A that is disposed on the inner side in the radial direction of fixing member 14, is disposed in the circumferential direction on the back surface of diaphragm 8, is in contact with the back surface, and supports diaphragm 8, and second support member 18A that is disposed on the inner side in the radial direction of first support member 16A, is disposed in the circumferential direction on the back surface of diaphragm 8, is in contact with the back surface, supports diaphragm 8, and has a contact area with the back surface that is smaller than a contact area of first support member 16A and the back surface.

In flat speaker 2A configured as described above, a value of hardness and/or a value of internal loss increases in the order of second support member 18A, first support member 16A, and fixing member 14. By doing this, a vibration that is transmitted from drive unit 10 to outer circumference 8*a* of diaphragm 8 is gradually absorbed by second support member 18A, first support member 16A, and fixing member 14, and a vibration that is reflected by outer circumference 8*a* of diaphragm 8 and is transmitted to drive unit 10 is reduced. As a result, similarly to flat speaker 2 described in the first exemplary embodiment, both of the vibrations described above (the vibration that is transmitted from drive unit 10 to outer circumference 8*a* of diaphragm 8 and the vibration that is reflected by outer circumference 8*a* of diaphragm 8 and is transmitted to drive unit 10) can be sufficiently canceled. Therefore, division resonance of diaphragm 8 can be suppressed, and acoustic characteristics of flat speaker 2A can be improved (frequency characteristics can be flattened).

The flat speaker may further include a third support member that is disposed in a position that corresponds to a belly in which a vibration of the diaphragm increases, and that supports the back surface of the diaphragm.

Third support member 20A is an example of the third support member.

As an example, flat speaker 2A described in the second exemplary embodiment further includes third support members 20A that are disposed in a position that corresponds to a belly in which the vibration of diaphragm 8 increases, and that support the back surface of diaphragm 8.

In flat speaker 2A configured as described above, secondary resonance and the like of diaphragm 8 can be suppressed from being generated, and the acoustic characteristics of flat speaker 2A can be further improved.

In the flat speaker, the first support member may include a plurality of first supports that are disposed side by side in the circumferential direction of the back surface of the diaphragm and that each extend from an inner circumference of the fixing member so as to be tapered. The second support member may include a plurality of second supports that each extend from a top of each of the plurality of first supports so as to be tapered.

First support 54 is an example of the first support. Second support 56 is an example of the second support.

As an example, in flat speaker 2A described in the second exemplary embodiment, first support member 16A includes the plurality of first supports 54 that are disposed side by side in the circumferential direction of the back surface of diaphragm 8 and that each extend from the inner circumference of fixing member 14 so as to be tapered. Second support member 18A includes the plurality of second supports 56 that each extend from the top of each of the plurality of first supports 54 so as to be tapered.

In flat speaker 2A configured as described above, a value of hardness and/or a value of internal loss increases in the order of second support member 18A, first support member 16A, and fixing member 14. By doing this, the vibration that is transmitted from drive unit 10 to outer circumference 8*a* of diaphragm 8 is gradually absorbed by second support member 18A, first support member 16A, and fixing member 14. As a result, similarly to flat speaker 2 described in the first exemplary embodiment, the acoustic characteristics of flat speaker 2A can be improved.

Third Exemplary Embodiment

Next, a third exemplary embodiment is described with reference to FIGS. 9 and 10.

[3-1. Configuration of Flat Speaker]

A configuration of flat speaker 2B according to the third exemplary embodiment is described with reference to FIGS. 9 and 10.

Figure 9:
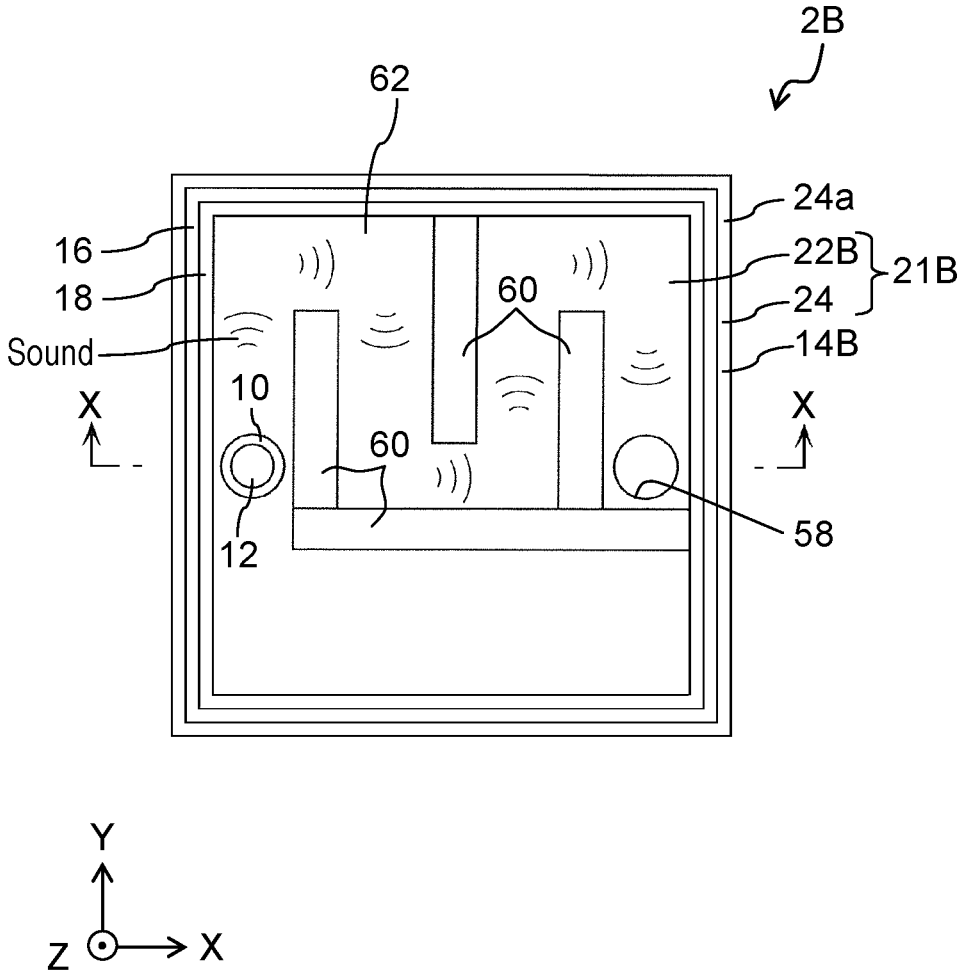
FIG. 9 is a plan view schematically illustrating an example of a configuration of a flat speaker according to a third exemplary embodiment.

FIG. 9 is a plan view schematically illustrating an example of the configuration of flat speaker 2B according to the third exemplary embodiment. FIG. 9 illustrates a plan view in which flat speaker 2B from which diaphragm 8 (see FIG. 2) is removed is viewed from the Z-axis positive direction side.

Figure 10:
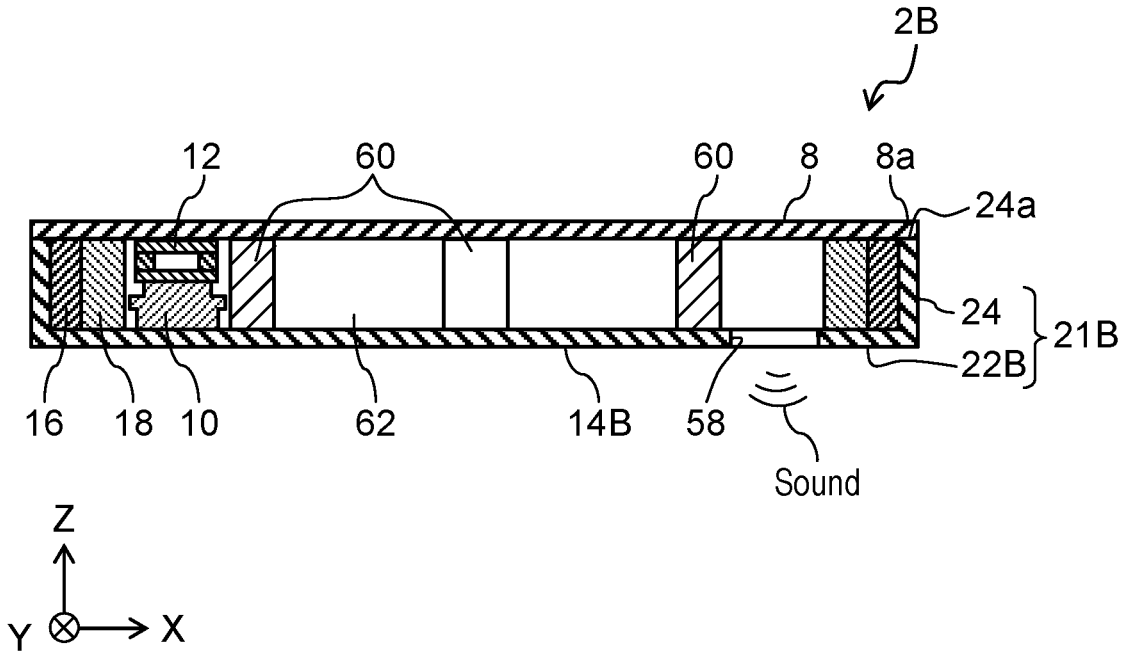
FIG. 10 is a sectional view schematically illustrating an example of the configuration of the flat speaker according to the third exemplary embodiment.

FIG. 10 is a sectional view schematically illustrating an example of the configuration of flat speaker 2B according to the third exemplary embodiment. The sectional view of FIG. 10 is a sectional view taken along line X-X in FIG. 9. In FIG. 10, simplified drive unit 10 is illustrated for convenience.

Most of components that configure flat speaker 2B according to the third exemplary embodiment are in common with components of flat speaker 2 described in the first exemplary embodiment, and a detailed description is omitted. However, flat speaker 2B according to the third exemplary embodiment is different from flat speaker 2 described in the first exemplary embodiment and flat speaker 2A described in the second exemplary embodiment in that flat speaker 2 and flat speaker 2A are sealed speakers but flat speaker 2B is a speaker that includes sound hole 58 (an opening) through which back sound of diaphragm 8 is emitted to an outside.

In addition, a disposition position of drive unit 10 is different between flat speaker 2B and flat speaker 2 described in the first exemplary embodiment. In flat speaker 2B, drive unit 10 is disposed, for example, near second support member 18 that is parallel to the Y-axis on the X-axis negative direction side.

As illustrated in FIG. 9 and FIG. 10, in bottom plate 22B of housing 21B of fixing member 14B, sound hole 58 having a circular shape in a plan view (when viewed from the Z-axis direction) is formed so as to have, for example, a size that is almost the same as a size of drive unit 10. Sound hole 58 is a port that mutually communicates an inside and an outside of housing 21B.

In flat speaker 2B, sound hole 58 is provided in a position apart from drive unit 10, for example, near second support member 18 that is parallel to the Y-axis on the X-axis positive direction side.

A plurality of partition walls 60 that form sound path 62 are disposed inside housing 21B. The plurality of partition walls 60 are fixed to each of the back surface (the surface on the Z-axis negative direction side) of diaphragm 8 and the upper surface (the surface on the Z-axis positive direction side) of bottom plate 22B of fixing member 14B by using an adhesive member such as an adhesive. Each of the plurality of partition walls 60 is formed, for example, of sponge or resin. Due to the plurality of partition walls 60, sound path 62 that guides sound generated by drive unit 10 to sound hole 58 is formed inside housing 21B. As illustrated in FIG. 9, sound path 62 extends, for example, from drive unit 10 to sound hole 58 in a meandering manner.

In flat speaker 2B, disposition positions of drive unit 10 and sound hole 58, a size of sound hole 58, and a number of and disposition positions of partition walls 60 are by no means limited to the configuration illustrated in FIG. 9. The disposition positions of drive unit 10 and sound hole 58, the size of sound hole 58, and the number of and the disposition positions of partition walls 60 may be appropriately set according to specifications, acoustic characteristics, and the like of flat speaker 2B.

[3-2. Effects]

As described above, in a flat speaker according to the present exemplary embodiment, a fixing member may include a housing that has a box shape and in which a drive unit, a first support member, and a second member are disposed, and a sound hole that is formed in the housing and communicates an inside and an outside of the housing. The flat speaker may further include a partition wall that is disposed in the housing and that forms a sound path that guides sound generated by the drive unit to the sound hole.

Flat speaker 2B is an example of the flat speaker. Fixing member 14B is an example of the fixing member. Housing 21B is an example of the housing. Sound hole 58 is an example of the sound hole. Sound path 62 is an example of the sound path. Partition wall 60 is an example of the partition wall.

As an example, in flat speaker 2B described in the third exemplary embodiment, fixing member 14B includes housing 21B that has a box shape and in which drive unit 10, first support member 16, and second member 18 are disposed, and sound hole 58 that is formed in housing 21B and communicates the inside and the outside of housing 21B. Flat speaker 2B further includes partition walls 60 that are disposed in housing 21B and that form sound path 62 that guides sound generated by drive unit 10 to sound hole 58.

In flat speaker 2B configured as described above, the sound generated by drive unit 10 is propagated through sound path 62, and is emitted to the outside of housing 21B via sound hole 58. As a result, in flat speaker 2B, a lower register can be efficiently reproduced.

Fourth Exemplary Embodiment

Next, a fourth exemplary embodiment is described with reference to FIG. 11.

[4-1. Configuration of Flat Speaker]

A configuration of flat speaker 2C according to the fourth exemplary embodiment is described with reference to FIG. 11.

Figure 11:
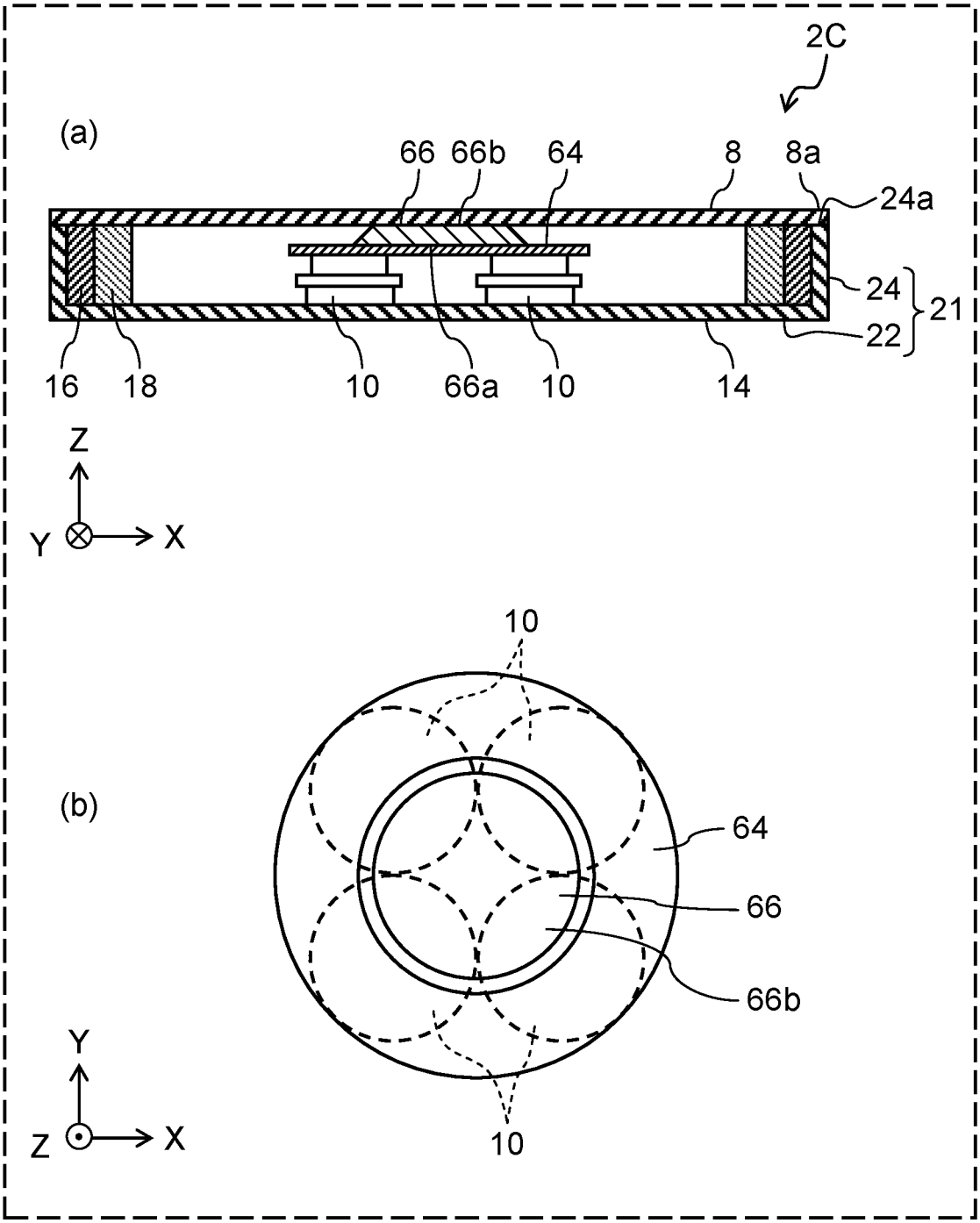
FIG. 11 is a diagram schematically illustrating an example of a configuration of a flat speaker according to a fourth exemplary embodiment.

FIG. 11 is a diagram schematically illustrating an example of the configuration of flat speaker 2C according to the fourth exemplary embodiment. Part (a) of FIG. 11 is a sectional view illustrating flat speaker 2C according to the fourth exemplary embodiment, and part (b) of FIG. 11 is a plan view (a plan view viewed from the Z-axis positive direction side) that selectively illustrates a plurality of drive units 10, coupling plate 64, and transmitter 66 that are included in flat speaker 2C according to the fourth exemplary embodiment.

The configuration of flat speaker 2C according to the fourth exemplary embodiment is substantially identical to the configuration of flat speaker 2 described in the first exemplary embodiment, and a detailed description is omitted. However, flat speaker 2C according to the fourth exemplary embodiment is different from the flat speakers described in the other exemplary embodiments in that the plurality of drive units 10 are disposed close to each other so as to configure a single speaker.

As illustrated in parts (a) and (b) of FIG. 11, flat speaker 2C according to the fourth exemplary embodiment includes the plurality (for example, 4) of drive units 10. The plurality of drive units 10 are disposed side by side in the circumferential direction. The plurality of drive units 10 are formed to have a circular shape in a plan view (when viewed from the Z-axis direction), and are coupled with each other by coupling plate 64 that is formed to have a flat plate shape. By doing this, the plurality of drive units 10 can be regarded as a single drive unit in appearance. Coupling plate 64 is formed, for example, of resin.

Between coupling plate 64 and diaphragm 8, transmitter 66 is clamped that transmits a vibration of each of the plurality of drive units 10 to diaphragm 8. Transmitter 66 is formed to have a truncated cone shape for which a diameter gradually decreases in the Z-axis positive direction. Transmitter 66 is formed, for example, of resin.

First end 66*a* (an end on a lower side (the Z-axis negative direction side) in part (a) of FIG. 11) of transmitter 66 is in contact with an upper surface (a surface on the Z-axis positive direction side) of coupling plate 64 by a first contact area. On the other hand, second end 66*b* (an end on an upper side (the Z-axis positive direction side) in part (a) of FIG. 11) of transmitter 66 is in contact with the back surface (the surface on the Z-axis negative direction side) of diaphragm 8 by a second contact area smaller than the first contact area.

[4-2. Effects]

As described above, in a flat speaker according to the present exemplary embodiment, a plurality of drive units may be provided. The flat speaker may further include a coupling plate that couples the plurality of drive units with each other. The flat speaker may further include a transmitter that includes a first end that is in contact with the coupling plate by a first contact area and a second end that is in contact with the diaphragm by a second contact area smaller than the first contact area, and that is clamped between the coupling plate and the diaphragm.

Flat speaker 2C is an example of the flat speaker. Coupling plate 64 is an example of the coupling plate. First end 66*a* is an example of the first end. Second end 66*b* is an example of the second end. Transmitter 66 is an example of the transmitter.

As an example, in flat speaker 2C described in the fourth exemplary embodiment, the plurality (for example, 4) of drive units 10 are provided. Flat speaker 2C further includes coupling plate 64 that couples the plurality of drive units 10 with each other. Flat speaker 2C further includes transmitter 66 that includes first end 66*a* that is in contact with coupling plate 64 by the first contact area and second end 66*b* that is in contact with diaphragm 8 by the second contact area smaller than the first contact area, and that is clamped between coupling plate 64 and diaphragm 8.

In flat speaker 2C configured as described above, the plurality of drive units 10 are coupled with each other by coupling plate 64. Therefore, as an example, even when a thickness (a size in the Z-axis direction) of magnet 38 (see FIG. 5) of each of the plurality of drive units 10 is reduced, an entire output of the plurality of drive units 10 can be maintained to be large.

Assume that flat speaker 2C is not provided with transmitter 66 and coupling plate 64 is in direct contact with the back surface (the surface on the Z-axis negative direction side) of diaphragm 8. A contact area of coupling plate 64 and diaphragm 8 relatively increases, and sound from each of the plurality of drive units 10 may interfere with each other in a high frequency range.

However, in flat speaker 2C according to the present exemplary embodiment, transmitter 66 is clamped between coupling plate 64 and diaphragm 8. Therefore, coupling plate 64 is not in direct contact with the back surface (the surface on the Z-axis negative direction side) of diaphragm 8 but is in indirect contact with the back surface via transmitter 66. A contact area of transmitter 66 in contact with coupling plate 64 and diaphragm 8 can be reduced in comparison with a case where coupling plate 64 is in direct contact with the back surface (the surface on the Z-axis negative direction side) of diaphragm 8. By doing this, in flat speaker 2C, sound from each of the plurality of drive units 10 can be suppressed from interfering with each other in a high frequency range. As a result, in flat speaker 2C, a higher register can be efficiently reproduced.

Other Exemplary Embodiments

As described above, the first to fourth exemplary embodiments have been described to exemplify a technique disclosed in the present application. However, the technique in the present disclosure is not limited to these exemplary embodiments, and is also applicable to exemplary embodiments subjected to changes, replacements, additions, omissions, or the like. In addition, a new exemplary embodiment can be made by combining respective components described in the first to fourth exemplary embodiments described above.

Accordingly, other exemplary embodiments are described below.

In the first to fourth exemplary embodiments, an example has been described in which display device 4 equipped with flat speaker 2 (2A, 2B, 2C) is configured by a liquid crystal television receiver. However, the present disclosure is by no means limited to this configuration example. Display device 4 may be configured, for example, by an organic electro luminescence (EL) display, an on-vehicle display, a liquid crystal display for a personal computer, a tablet terminal, or a smartphone.

In the first to fourth exemplary embodiments, a configuration example has been described in which heat insulating member 12 (12A) includes first heat insulating plate 46, second heat insulating plate 48, and connectors 50 (50A). However, the present disclosure is by no means limited to this configuration example. As an example, from among these components, first heat insulating plate 46 may be omitted.

In the first to fourth exemplary embodiments, a configuration example has been described in which fixing member 14 (14B) is formed of resin. However, the present disclosure is by no means limited to this configuration example. Fixing member 14 (14B) may be formed of various materials such as metal, wood, robber, or sponge.

In the first, third, and fourth exemplary embodiments, a configuration example has been described in which first support member 16 and second support member 18 are continuously disposed in the circumferential direction of the back surface (the surface on the Z-axis negative direction side) of diaphragm 8. However, the present disclosure is by no means limited to this configuration example. First support member 16 and second support member 18 may be discretely disposed in the circumferential direction of the back surface of diaphragm 8 in such a way that a disposition density of a plurality of first support members 16 is higher than a disposition density of a plurality of second support members 18.

In the first to fourth exemplary embodiments, a configuration example has been described in which fixing member 14 (14B) is formed to have a box shape. However, the present disclosure is by no means limited to this configuration example. Fixing member 14 (14B) may be formed, for example, to have a frame shape.

In the first to fourth exemplary embodiments, a configuration example has been described in which each of first support member 16 (16A) and second support member 18 (18A) is formed of sponge. However, the present disclosure is by no means limited to this configuration example. Each of first support member 16 (16A) and second support member 18 (18A) may be formed, for example, of resin or rubber.

In the first to fourth exemplary embodiments, a configuration example has been described in which a two-layer support member structure is disposed on the inner side in the radial direction of side wall 24 of fixing member 14 (14B) on the upper surface (the surface on the Z-axis positive direction side) of bottom plate 22 (22B) of fixing member 14 (14B) and the two-layer support member structure is formed by first support member 16 (16A) and second support member 18 (18A). However, the present disclosure is by no means limited to this configuration example. As an example, a three-layer support member structure or a support member structure including four or more layers may be disposed on the inner side in the radial direction of side wall 24 on the upper surface (the surface on the Z-axis positive direction side) of bottom plate 22 (22B) of fixing member 14 (14B).

In the first to fourth exemplary embodiments, a configuration example has been described in which first heat insulating plate 46, second heat insulating plate 48, and the plurality of connectors 50 (50A) are formed of materials different from each other. However, the present disclosure is by no means limited to this configuration example. As an example, first heat insulting plate 46, second heat insulating plate 48, and the plurality of connectors 50 (50A) may be formed of the same material.

As described above, the exemplary embodiments have been described as examples of the technique according to the present disclosure. The accompanying drawings and the detailed description have been provided for this purpose.

Accordingly, the components described in the accompanying drawings and the detailed description may not only include components that are essential for solving the problems, but may also include components that are not essential for solving the problems in order to illustrate the technique. For this reason, even if these unessential components are described in the accompanying drawings and the detailed description, these unessential components should not be immediately approved as being essential.

The exemplary embodiments above are provided to exemplify the technique according to the present disclosure, and thus various changes, replacements, additions, omissions, and the like can be made within the scope of the claims and equivalents of the claims.

INDUSTRIAL APPLICABILITY

The present disclosure is applicable to a flat speaker that is equipped in a display device such as a liquid crystal television receiver.

REFERENCE MARKS IN THE DRAWINGS

2, 2A, 2B, 2C: flat speaker
4: display device
6: display panel
8: diaphragm
8*a*: outer circumference
10: drive unit
12, 12A: heat insulating member
14, 14B: fixing member
16, 16A: first support member
18, 18A: second support member
20, 20A: third support member
21, 21B: housing
22, 22B: bottom plate
24: side wall
24*a*: opening edge
26: magnetic circuit
28: bobbin
30: voice coil
32: flange
34: damper
36: yoke
38: magnet
40: plate
42: recess
44: magnetic gap
46: first heat insulating plate
48: second heat insulating plate
50, 50A: connector
52, 52A: air layer
54: first support
56: second support
58: sound hole
60: partition wall
62: sound path
64: coupling plate
66: transmitter
66*a*: first end
66*b*: second end

The invention claimed is:

1. A flat speaker comprising:
a diaphragm having a flat plate shape;
a drive unit that is attached to a back surface of the diaphragm and vibrates the diaphragm;
a fixing member that fixes an outer circumference of the diaphragm in a circumferential direction;
a first support member that is disposed on an inner side in a radial direction of the fixing member, is fixed to the back surface of the diaphragm and an upper surface of a bottom plate of the fixing member, and has a value of hardness smaller than a value of hardness of the fixing member and/or a value of internal loss larger than a value of internal loss of the fixing member; and
a second support member that is disposed on an inner side in the radial direction of the first support member, is fixed to the back surface of the diaphragm and the upper surface of the bottom plate of the fixing member, and has a value of hardness smaller than the value of hardness of the first support member and/or a value of internal loss larger than the value of internal loss of the first support member.

2. A flat speaker comprising:
a diaphragm having a flat plate shape;
a drive unit that is attached to a back surface of the diaphragm and vibrates the diaphragm;
a fixing member that fixes an outer circumference of the diaphragm in a circumferential direction;
a first support member that is disposed on an inner side in a radial direction of the fixing member, is disposed in the circumferential direction on the back surface of the diaphragm and the fixing member, is in contact with the back surface of the diaphragm and an upper surface of a bottom plate of the fixing member, and supports the diaphragm; and
a second support member that is disposed on an inner side in the radial direction of the first support member, is disposed in the circumferential direction on the back surface of the diaphragm, is in contact with the back surface of the diaphragm and the upper surface of the bottom plate of the fixing member, supports the diaphragm, and has a contact area with the back surface that is smaller than a contact surface of the first support member and the back surface.

3. The flat speaker according to claim 1, further comprising a third support member that is disposed in a position that corresponds to a belly wherein a vibration of the diaphragm increases, the third support member supporting the back surface of the diaphragm.

4. The flat speaker according to claim 1, wherein each of the first support member and the second support member continuously extends over an entire circumference of the back surface of the diaphragm.

5. The flat speaker according to claim 2, wherein
the first support member includes a plurality of first supports that are disposed side by side in the circumferential direction of the back surface of the diaphragm and that each extend from an inner circumference of the fixing member so as to be tapered, and
the second support member includes a plurality of second supports that each extend from a top of each of the plurality of first supports so as to be tapered.

6. The flat speaker according to claim 1, wherein
the fixing member includes:
a housing that has a box shape, the drive unit, the first support member, and the second support member being disposed in the housing; and
a sound hole that is formed in the housing and that communicates an inside and an outside of the housing, and
the flat speaker further includes a partition wall that is disposed in the housing and that forms a sound path that guides sound generated by the drive unit to the sound hole.

7. The flat speaker according to claim 1, further comprising a heat insulating member that is clamped between the diaphragm and the drive unit and that includes an air layer.

8. The flat speaker according to claim 7, wherein
the heat insulating member includes:
a first heat insulating plate that is in contact with the back surface of the diaphragm;

a second heat insulating plate that is disposed so as to be spaced apart from the first heat insulating plate and that is in contact with the drive unit; and a connector that connects the first heat insulating plate and the second heat insulating plate and that forms the air layer between the first heat insulating plate and the second heat insulating plate, and the first heat insulting plate, the second heat insulating plate, and the connector are formed of materials different from each other.

9. The flat speaker according to claim 1, wherein a plurality of the drive units are provided, and the flat plate further includes:

a coupling plate that couples the plurality of the drive units with each other; and a transmitter that includes a first end that is in contact with the coupling plate by a first contact area and a second end that is in contact with the diaphragm by a second contact area smaller than the first contact area, the transmitter being clamped between the coupling plate and the diaphragm.

10. A display device comprising the flat speaker according to claim 1.

11. The flat speaker according to claim 2, further comprising a third support member that is disposed in a position that corresponds to a belly wherein a vibration of the diaphragm increases, the third support member supporting the back surface of the diaphragm.

12. The flat speaker according to claim 2, wherein the fixing member includes:

a housing that has a box shape, the drive unit, the first support member, and the second support member being disposed in the housing; and a sound hole that is formed in the housing and that communicates an inside and an outside of the housing, and the flat speaker further includes a partition wall that is disposed in the housing and that forms a sound path that guides sound generated by the drive unit to the sound hole.

13. The flat speaker according to claim 2, further comprising a heat insulating member that is clamped between the diaphragm and the drive unit and that includes an air layer.

14. The flat speaker according to claim 13, wherein the heat insulating member includes:

a first heat insulating plate that is in contact with the back surface of the diaphragm;

a second heat insulating plate that is disposed so as to be spaced apart from the first heat insulating plate and that is in contact with the drive unit; and a connector that connects the first heat insulating plate and the second heat insulating plate and that forms the air layer between the first heat insulating plate and the second heat insulating plate, and the first heat insulting plate, the second heat insulating plate, and the connector are formed of materials different from each other.

15. The flat speaker according to claim 2, wherein a plurality of the drive units are provided, and the flat plate further includes:

a coupling plate that couples the plurality of the drive units with each other; and a transmitter that includes a first end that is in contact with the coupling plate by a first contact area and a second end that is in contact with the diaphragm by a second contact area smaller than the first contact area, the transmitter being clamped between the coupling plate and the diaphragm.

16. A display device comprising the flat speaker according to claim 2.

* * * * *